United States Patent [19]

Jacobson

[11] Patent Number: 4,733,092

[45] Date of Patent: Mar. 22, 1988

[54] INTERNAL RADIATION ATTENUATION SYSTEM

[76] Inventor: Earl B. Jacobson, 510 S. Shore Dr., Crystal Lake, Ill. 60014

[21] Appl. No.: 771,937

[22] Filed: Sep. 3, 1987

[51] Int. Cl.[4] ..... G21C 11/00; G21F 1/00; G21F 3/04

[52] U.S. Cl. ..... 250/515.1; 250/517.1; 376/287

[58] Field of Search ..... 250/515.1, 517.1, 519.1; 376/287

[56] References Cited

U.S. PATENT DOCUMENTS

| | | | |
|---|---|---|---|
| 2,720,105 | 10/1955 | Billups | 250/517.1 |
| 3,123,576 | 3/1964 | Klein | 376/287 |
| 3,286,094 | 11/1966 | Pretto | 250/519.1 |
| 3,299,270 | 1/1967 | D'Avella | 250/517.1 |
| 3,785,925 | 1/1974 | Jones | 376/287 |
| 4,339,163 | 7/1982 | Jacobson et al. | 250/515.1 |
| 4,400,623 | 8/1983 | Jacobson | 250/519.1 |
| 4,432,932 | 2/1984 | Jacobson | 376/287 |
| 4,530,813 | 7/1985 | Jacobson | 376/287 |

FOREIGN PATENT DOCUMENTS

| | | | |
|---|---|---|---|
| 2525802 | 10/1983 | France | 376/287 |
| 2534730 | 4/1984 | France | 250/515.1 |

*Primary Examiner*—Deborah L. Kyle
*Assistant Examiner*—Richard W. Wendtland
*Attorney, Agent, or Firm*—Silverman, Cass, Singer & Winburn, Ltd.

[57] ABSTRACT

An internal radiation attenuation system for a substantially enclosed radioactive work environment to protect and shield workers therein from radiation. The system decreases health hazards for workers and increases the safety margin within the environment. The method contemplates utilizing a frame which is formed from a plurality of interlocking segments which are quickly and easily assembled and disassembled. A plurality of radiation attenuation panels are slidably engaged upon the upper portion of the frame and a second plurality of radiation attenuation pads can be engaged to hang from the sides of the frame to substantially enclose a worker therein.

10 Claims, 10 Drawing Figures

INTERNAL RADIATION ATTENUATION SYSTEM

BACKGROUND OF THE INVENTION

The invention relates generally to radiation shielding or attenuating systems and more particularly to a method and system which enables workers to work in an enclosed radioactive workspace safely for long periods with freedom of movement in the workspace.

In nuclear power plants, steam generators typically are utilized as heat exchangers between the reactor and a power generating steam turbine. The steam generators have hundreds or thousands of heat exchange tubes in single pass or double pass loop tubes inside the generator housing, which typically are sixty feet high. The tubes carry contaminated water, at high temperature and pressure from the reactor, through the generators, which in turn transfers heat to water around the tubes, creating steam to drive the turbine. Periodically, typically during a reactor refueling outage, or if a leak occurs, the tubes are checked to make sure they are not leaking or stressing to the point where they will leak contaminated water into the steam.

The tubes are checked by running a tester, typically an eddy current tester, over the length of each tube to be checked. Typically, unless a leak has occurred, some predetermined number of the thousands of tubes are checked during each outage so that during a period of time all the tubes are checked. The testers are operated and repairs or sealing off of leaking tubes are sometimes performed by workers physically climbing into the steam generators through a manway or portal into the bottom of the generator housing. The bottom of the generator housing or the workspace is typically called the channel head and generally is a quarter of a sphere (a half of a bowl) with a diameter of nine to twelve feet. The interior of the channel head presents workers with a main problem of a high radiation environment and a secondary problem of contact contamination with radioactive airborne particles which are on the interior surfaces of the housing and channel head and are dislodged by the workers themselves from the tubes and surfaces.

Due to the fact that the interior or workspace of the generator channel head is a high radiation environment, the workers are only permitted to be inside the generator for a few minutes at a time. The checking and repairs, therefore may require hundreds of entrances and exits. Many attempts to shield the radiation of the interior walls and tubes of the generator have been attempted with limited success. Most of these shielding approaches are very expensive and create radioactive wastes.

Further, the problem of contact contamination within the workspace requires respiratory protection for the workers, as well as causing surface contamination of the workers garments, which contamination is then brought out of the generator when the workers climb out of the portal. Each worker typically is attired in several layers of clothing covered by a plastic outer layer and a self contained breathing apparatus or supplied-air respirator. This makes it difficult to pass through the portals, which usually are small on the order of sixteen inches in diameter, and the clothing itself is cumbersome to work in.

Further, each time the worker leaves the generator at least the outer clothing which has radioactive contaminants on it has to be removed and disposed of. The area around the portal becomes contaminated and must be cleaned. The workers outside the generator are exposed to the contaminants brought out on the clothing and the worker himself is further exposed because the contaminants are in physical contact with the clothing and remain there while the clothing is further handled and disposed of.

The invention permits the workers to work in a radiation attenuated environment and with a decrease in the physical contact with the surfaces of the workspace once the system is assembled. The workers can work in the enclosed workspace of the steam generator channel head inside the system of the invention with a decrease in the physical exposure to the contaminants and a decrease in the carrying of contaminants outside the workspace. The radiation emitted by the surfaces and tubes of the generator, particularly the lower end portion of the tubes, is absorbed by a radiation attenuating medium of the system except where exposed for work on the generator. Thus, the shielding greatly reduces the radiation exposure per unit of time and also can reduce the contamination of workers and outside areas.

SUMMARY OF THE INVENTION

The above and other disadvantages of prior art contaminant control techniques and systems are overcome in accordance with the present invention by providing a radioactive attenuation or shielding system for an internal radioactive work environment. The system shields the workers from a major portion of the radiation, thereby increasing the length of time the worker can remain in the work environment. The system includes a frame forming a skeleton around the periphery of the internal radioactive work environment, such as the channel head workspace inside a nuclear power plant steam generator. The frame includes a plurality of segments which interlock with one another and can be rapidly assembled to minimize the exposure of the worker in the radioactive work environment. The frame includes supports for radiation attenuating panels or pads or blankets which are supported by the frame and which provide the radiation attenuation for the system.

The top of the workspace can be a semicircular area and the radiation attenuating panels can be formed in panels supported by the frame which can be moved in a fan type arrangement adjacent the top of the workspace. The panels can be moved to one side to expose areas to be worked upon. The frame also includes a support for radiation attenuation pads to be hung around the sides of the workspace.

DETAILED DESCRIPTION

Figure 1:
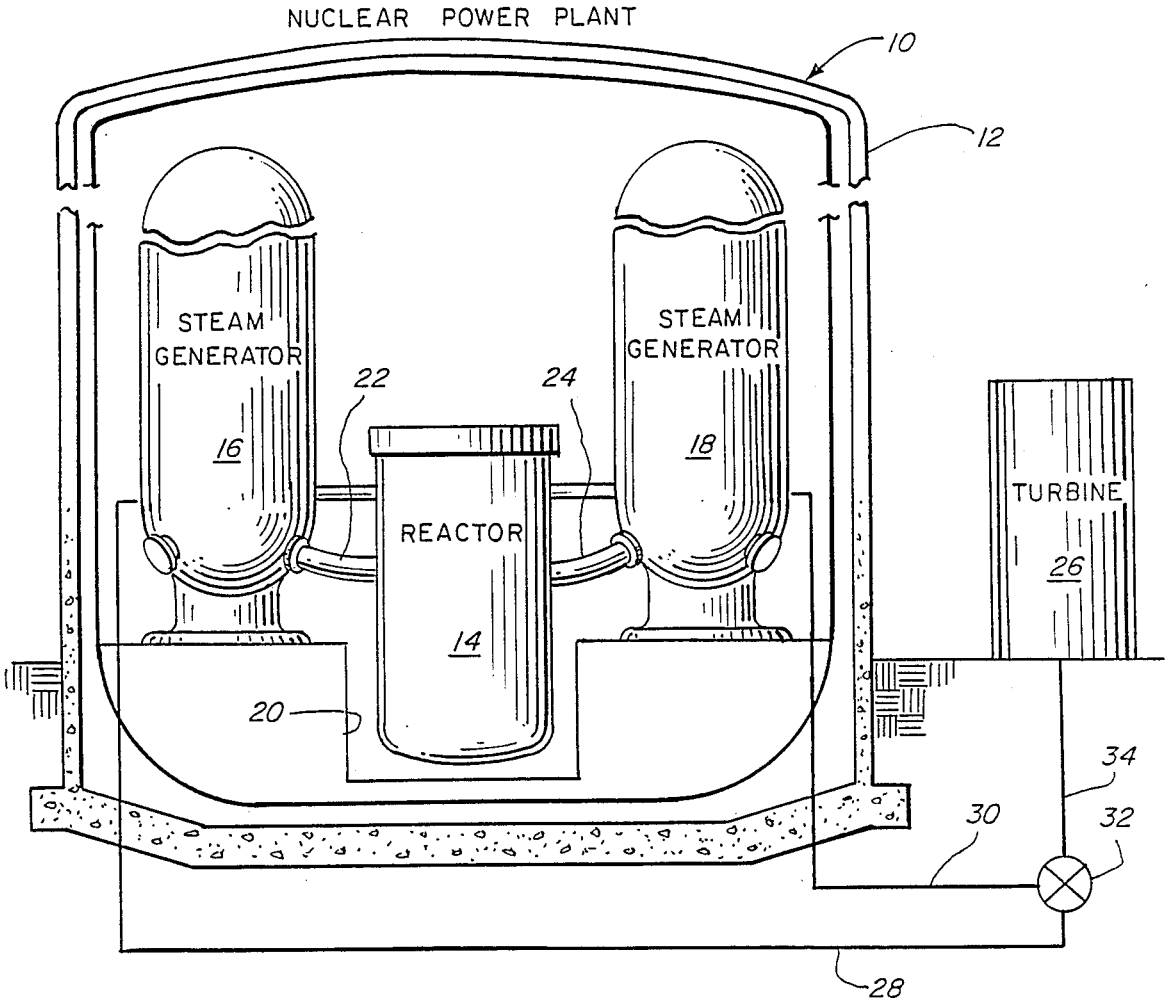
FIG. 1 is a partial block and diagrammatic view of a nuclear power plant.

Referring to FIG. 1, a typical nuclear power plant 10 includes a main building 12 in which are housed a reactor 14 and a pair of steam generators 16 and 18. The reactor 14 and generators 16 and 18 are installed in a floor 20. The reactor 14 is coupled to each generator 16 and 18 by respective lines 22 and 24. Each of the generators 16 and 18 is coupled to a power generating turbine 26 by lines 28 and 30 coupled through a valve 32 to a line 34.

Figure 2:
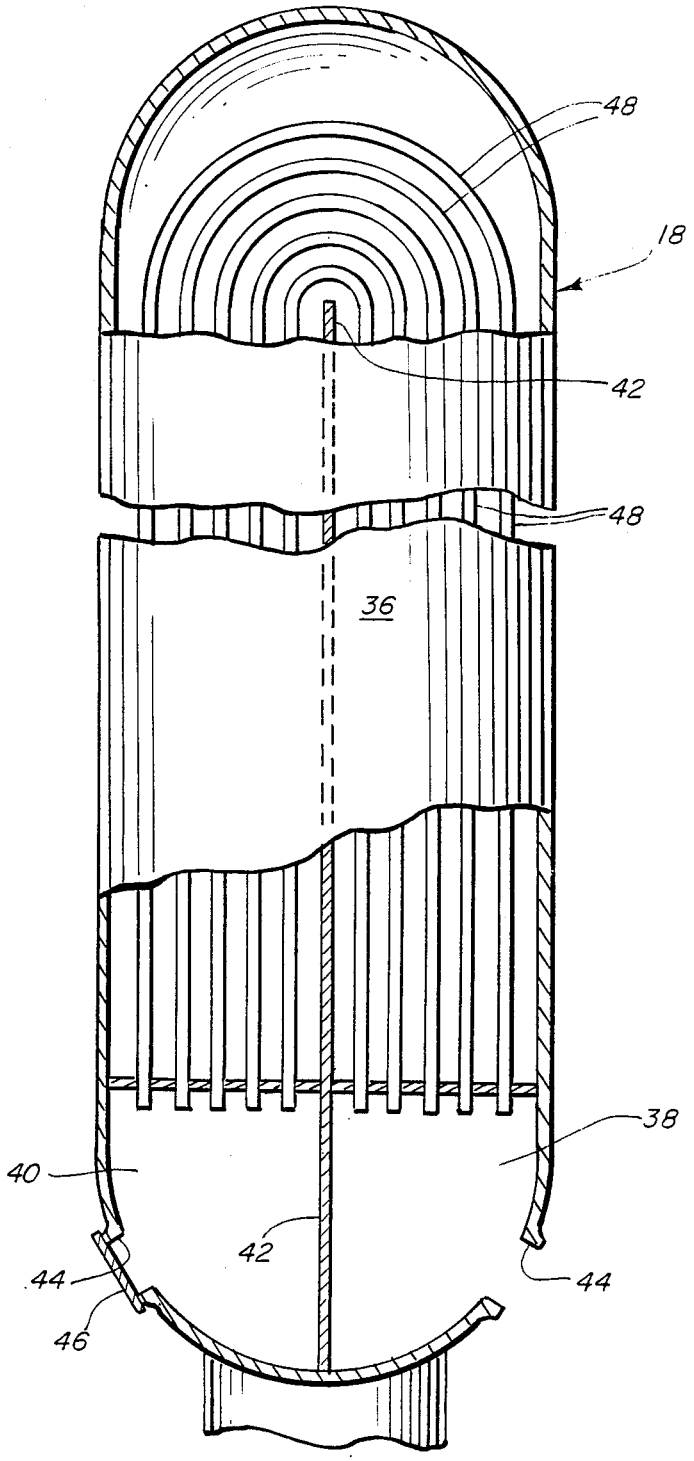
FIG. 2 is a side plan view of a steam generator having portions broken away.

Referring to FIG. 2, the generator 18 is illustrated in further detail The generator 18 includes an outer housing 36 and a pair of lower interior workspaces 38 and 40 in the channel head divided by a septum 42. As mentioned above, the workspaces 38 and 40 in the channel head each are shaped in the form of a half a bowl or a quarter of a sphere with a diameter typically of nine to twelve feet. The housing 36 includes a portal or manway 44 for each of the workspaces 38 and 40 to provide access thereto. Each portal 44 is sealed and secured by a plate 46 during periods of non-inspection of the interior of the generator 18.

The generator 18 has thousands of heat transfer water tubes 48 extending the length thereof to exchange heat between hot water from a nuclear reactor within the tubes 48 and water outside the tubes 48, to create steam to run the power generator turbine 26. A tube checker or eddy current tester (not shown) will travel up and down each tube 48 to check for leaks or potential leaks. If any leak is found, it is repaired or the tube is sealed or plugged to prevent its use. Other work is also performed in the channel head and can include work on the nozzel openings for the lines 22 or 24. This can include a hydraulic plug to allow a portion of the plant area to be flooded.

Figure 3:
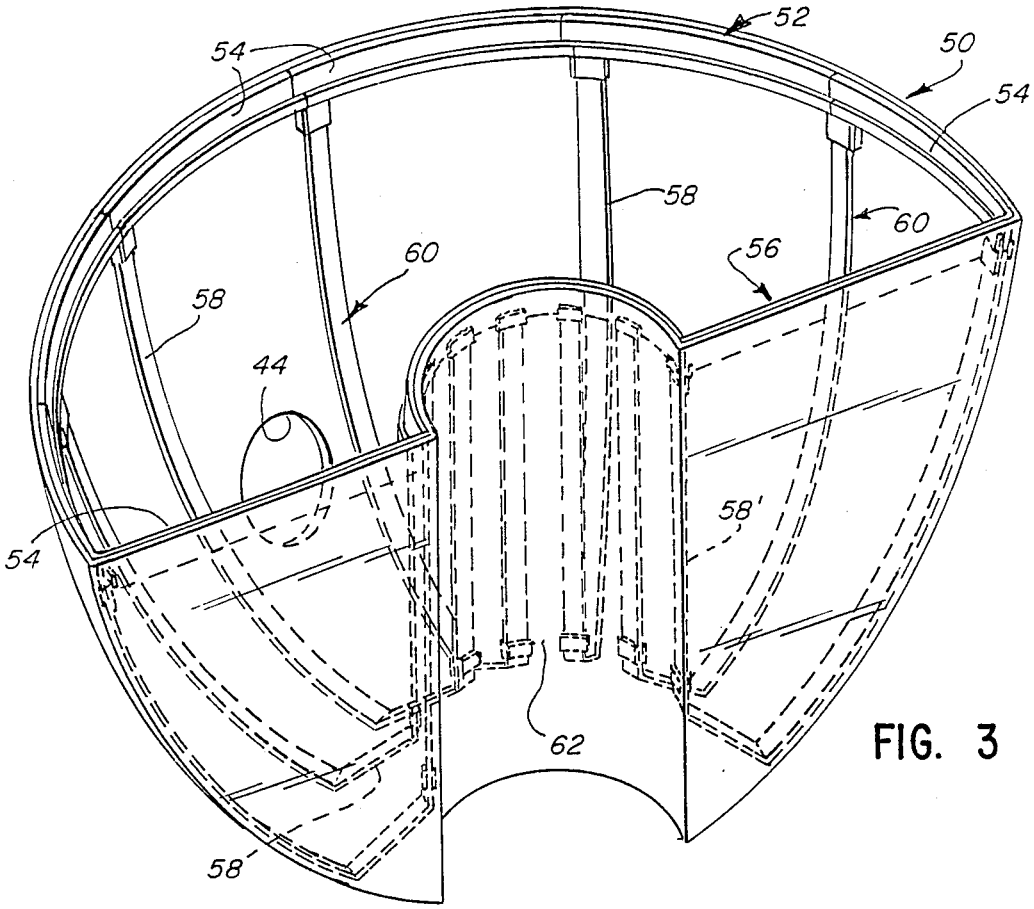
FIG. 3 is a perspective view of the present invention.

Referring now to FIG. 3, an internal radiation attenuation system embodying the present invention is designated generally by the reference numeral 50. The system 50, is assembled inside one or both of the workspaces 38 or 40 inside the steam generators 16 or 18. Although described in detail for utilization inside of a nuclear power plant steam generator, the system 50 of the invention can be utilized in any radioactive environment having a substantially enclosed radioactive workspace.

The system 50 includes a frame 52, which is formed from a plurality of segments 54 which form a continuous top band 56 for the workspace skeleton formed by the frame 52. The frame 52 further includes a plurality of rib segments 58 which interlock together to form a plurality of ribs 60, which support the top band 56 and a plurality of radiation attenuating pads, blankets or panels (not illustrated) to cover the top and/or the sides of the workspace. The system 50 is configured to closely fit within the workspace to provide the maximum work area and is shown configured with a wall 62 to fit around a center tubular steam generator passage (not illustrated).

The system frame 52 provides a self supporting frame for the pads or blankets, which are relatively heavy, and transfers their weight to the bottom and sides of the channel head without other supports. The majority of the radiation comes from the tube area in the upper part of the generator and it has been suggested to mount a shielding system for the tubes 48 themselves. This could be accomplished by expanding plugs, but besides the problem of additional weight on the tubes 48, the plugs can block tubes or areas which are to be worked on.

The system 50 can be easily and rapidly assembled and disassembled with the segments 54 and 58 and pads or panels being passed through the portal 44 into or out of the workspace. The system needs to be rapidly assembled because an unshielded worker can only stay in the workspace for a maximum of ten minutes. The frame 52 can be assembled and disassembled, with prior training in a mock up, in less than five minutes. During each outage, the system 50 can be utilized in the power plant. The system 50 will reduce exposure to the workers and increases the amount of time they can spend in the generator for work which may be taking place for two or more weeks of an eight week refueling outage.

Figure 4:
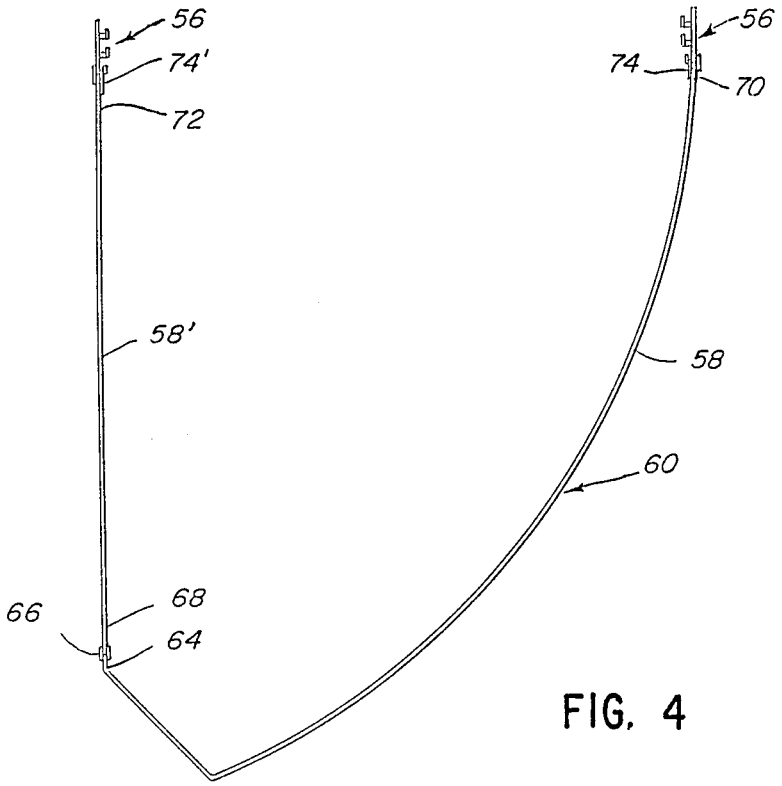
FIG. 4 is a side view of a portion of the frame of the present invention.

One rib 60 is illustrated in FIG. 4, and is formed from two segments 58 and 58' which are shaped to conform to the particular workspace configuration, here a particular steam generator 18. The center passage in the steam generator 18 can be omitted as illustrated in FIG. 2, in which case the tubular frame side wall portion 62 will be omitted and replaced by a substantially planar frame wall. The segments 58 and 58' interlock to form the rib 60 by inserting a front exposed end 64 of the segment 58 into a simple pocket 66 formed on a first end 68 of the second segment 58'. The second respective ends 70 and 72 of the ribs 58 and 58' are inserted into respective pockets 74 and 74' formed on the top band 56.

Figure 5:
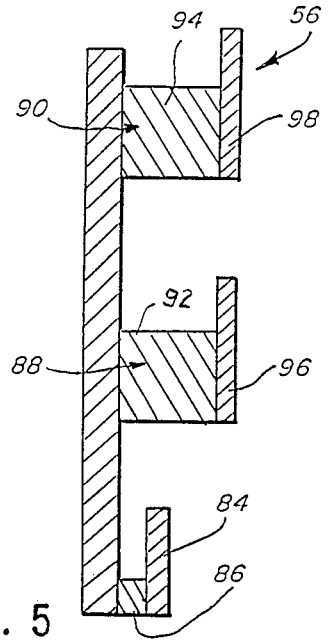
FIG. 5 is a side sectional view of the top frame and radiation attenuating panel supports of the present invention.
Figure 6:
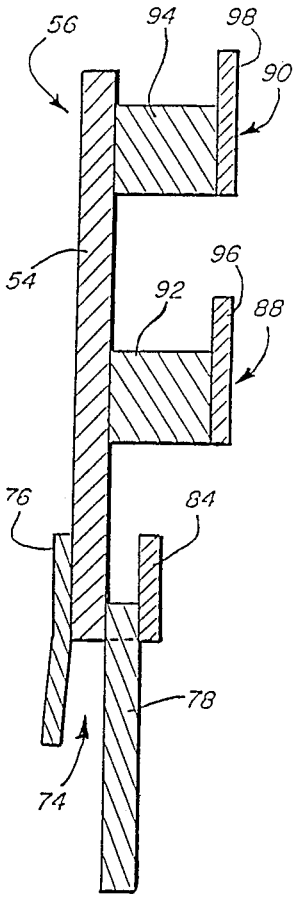
FIG. 6 is another side view of a portion of the frame of the present invention.
Figure 7:
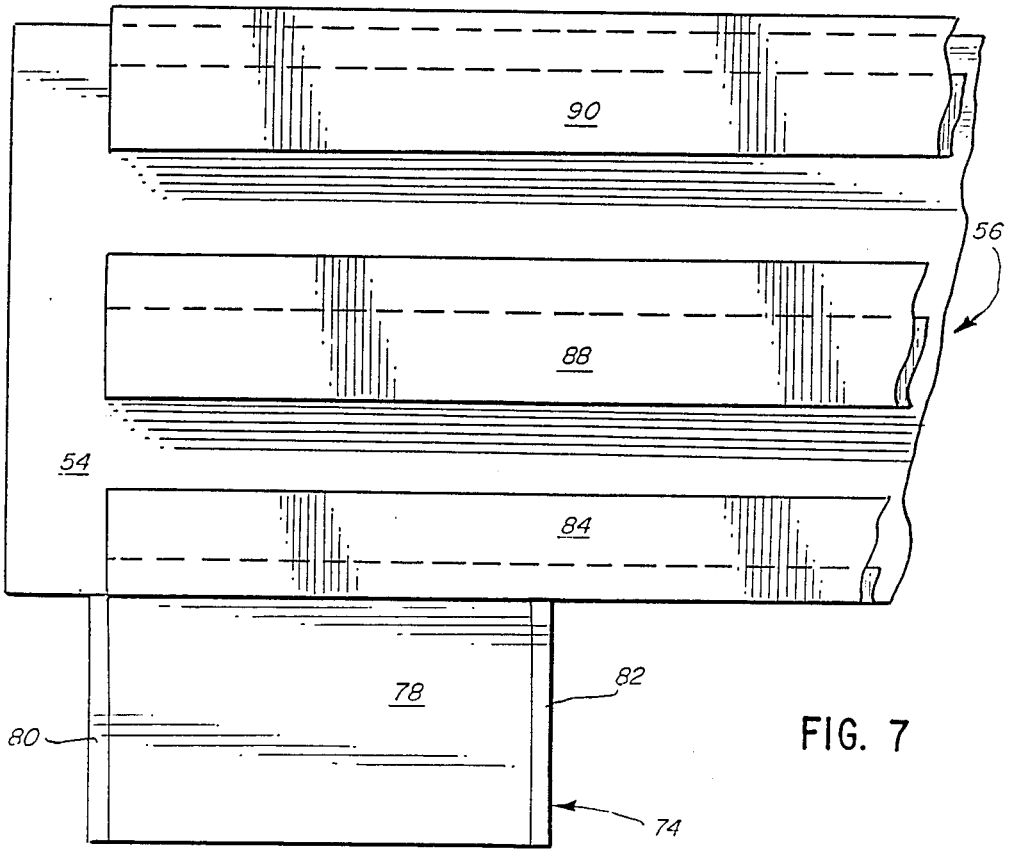
FIG. 7 is a plan view of the frame and radiation attenuating panel supports of the present invention.

The top band 56 is best illustrated in FIGS. 5–7. The band segment 54 includes the pocket 74 (FIGS. 6 and 7) which includes a back guide wall 76, affixed to the band segment 54 preferably by welding, which is bent outwardly to facilitate the insertion of the end 72 into the pocket 74. A front guide wall 78 is welded to the opposite side of the band segment 54 and the pocket 74 is completed by a pair of side walls 80 and 82. The pocket 74 is configured to slidingly engage the end 72 therein to form a substantially rigid frame 52.

The band segment 54 includes a lower support rail or wall 84. The rail 84 is mounted onto the guide wall 78 across the pocket 74 and is mounted onto a bar segment 86 between the pockets 74. The pockets 74 being spaced apart as desired to provide the necessary frame to support the attenuation material without being excessive in number. The minimum number of course enhances the speed with which the frame 52 can be assembled and disassembled.

The band segment 54 also includes a pair of upper rails 88 and 90. Each of the rails is formed by respective bars 92 and 94 affixed to the segment 54 and outer walls 96 and 98 formed on the outside thereof. The rails 84, 88 and 90 provide the support for the radiation attenuation panels or pads as best illustrated in FIGS. 8 and 9.

Figure 8:
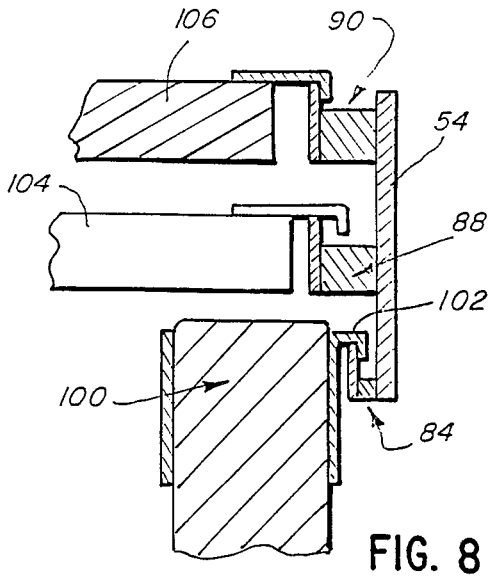
FIG. 8 is a side sectional view of one embodiment of radiation attenuating panels on the supports of the present invention.
Figure 9:
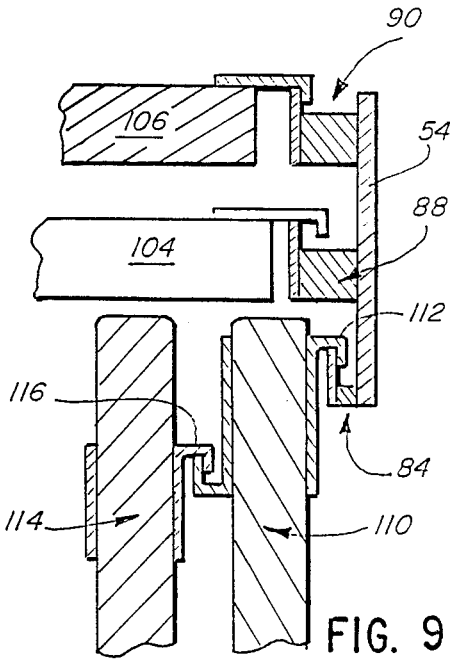
FIG. 9 is a side sectional view of a second frame and radiation attenuating panel support of the present invention.

Referring to FIG. 8, a single radiation attenuation pad or blanket 100 is mounted by a bracket 102 to hang from the support rail 84. The pads 100 preferably are formed to fit in an overlapping manner around the circumference of the workspace and are slidable upon the rail 84 for ease in installation and removal. The pads 100 can be formed as desired and preferably are formed of lead wool in accordance with the pads disclosed in Applicant's U.S. Pat. No. 4,432,932.

Figure 10:
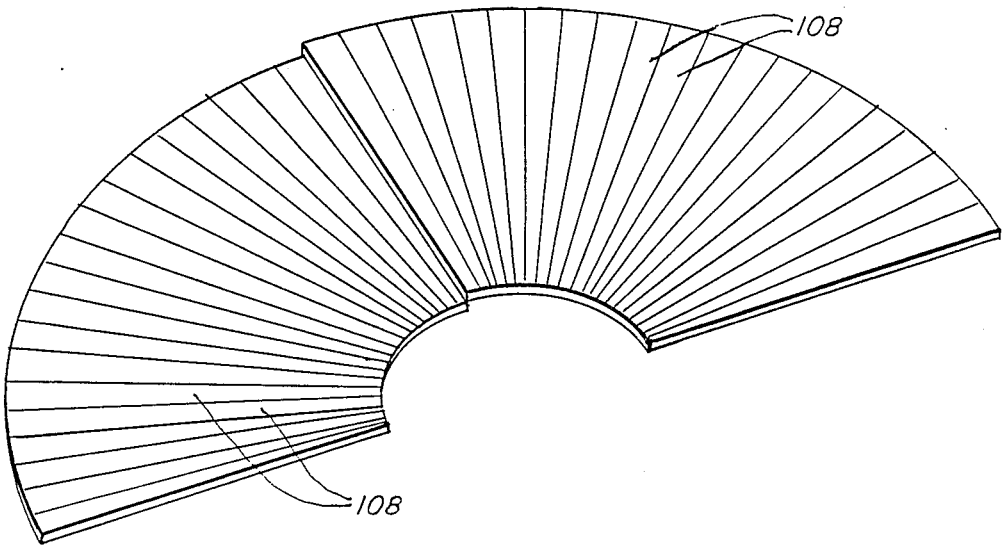
FIG. 10 is a perspective view of one embodiment of the top radiation attenuating panel assembly of the present invention.

Each of the upper rails 88 and 90 support a pan or tray 104 and 106 in which is disposed a plurality of slidable fan shaped panels 108 (FIG. 10). The panels 108 can be trays filled with lead to provide the desired radiation attenuation. The panels 108 could be mounted on one pan, but preferably are mounted on both pans 104 and 106. The spread out panels 108 preferably cover half of the area, such that as much as fifty percent of the area can be exposed for work thereon.

In assembling the system 50, first the frame 52 is assembled and then the panels 108 are fitted onto the upper rail 90 and slid around such that one or two remain above the worker to shield the worker from the radiation while installing the rest of the system 50. Once the panels 108 are in place, then the blankets 100 (if utilized) are mounted onto the railing 84 and moved around until the entire periphery is covered. The pads 100 and panels 108 then can be moved as desired to expose the necessary work area. Generally the pads or blankets 100, when utilized, are not moved once installed. Additional pads can be laid across the bottom of the workspace if desired.

Referring to FIG. 9, a blanket pad 110 is mounted by a bracket 112 onto the railing 84. A second pad or blanket 114 is then mounted by a second bracket 116 onto the bracket 112. It is preferable that the pads provide about two inches of attenuating material, but not weigh substantially more than sixty pounds. The pads 100 are two inches thick and therefore are more narrow than the one inch pads 110 and 114. Therefore the number of pads is about the same in either embodiment. The pads 110 and 114 are aligned to avoid direct radiation paths between adjacent overlapping ones of the pads 110 and 114.

The system and method of the present invention provides radiation shielding and protection for workers within an enclosed radioactive work environment allowing for increased working time within the environment. This is extremely advantageous in that the allowed radiation dose per calendar quarter for each worker is reached in three to five minutes without the use of this system.

Modifications and variations of the present invention are possible in light of the above teachings. The system 50 can be configured as desired and can be formed from any convenient materials. The system 50 is advantageous in that it is self supporting and does not have to be physically attached to the workspace. Further, only a portion of the top or sides of the workspace need be covered if desired. It is therefore to be understood that within the scope of the appended claims the invention may be practiced otherwise than as specifically described.

What is claimed and desired to be secured by Letters Patent of the United States is:

1. An internal radiation attenuation system for a radioactive environment having a substantially enclosed radioactive workspace having an internal configuration with at least one entrance portal, said workspace internal configuration having an upper wall or ceiling, side walls and a bottom wall, comprising:

means for forming a frame for supporting a plurality of radiation attenuation means to substantially conform to at least a portion of the inside of said workspace internal configuration, said frame means including a plurality of interlocking segments, including means for assembling said segments into said frame means, said interlocking segments form a skeleton spaced around the periphery of said internal workspace, interlocked with one another, said frame means further including means for supporting said radiation attenuation means around at least a portion of the periphery of said internal workspace, said frame means skeleton forming a free standing support structure standing and supported primarily by said bottom wall without vertical support from said ceiling.

2. The system as defined in claim 1 wherein said support means include means for supporting said radiation attenuation means adjacent the top of said internal workspace.

3. The system as defined in claim 2 wherein said radiation attenuation means include means for movably covering the top of said internal workspace.

4. The system as defined in claim 3 wherein said movable covering means include a plurality of radiation attenuation panels and means for moving said panels in a fan shaped path covering a substantially semicircular top portion.

5. The system as defined in claim 4 wherein said support means include means for supporting said panels in at least two separate fan shaped paths.

6. The system as defined in claim 1 wherein said support means include means for supporting said radiation attenuation means adjacent the sides of said internal workspace.

7. The system as defined in claim 6 wherein said radiation attenuation means include means for movably covering the sides of said internal workspace.

8. The system as defined in claim 1 wherein said interlocking segments form a skeleton spaced around the periphery of said internal workspace, interlocked with one another.

9. The system as defined in claim 8 wherein said interlocking segments include a plurality of rib portions which interlock forming the sides, and bottom of said skeleton.

10. The system as defined in claim 9 wherein said interlocking segments include a plurality of band portions which interlock around the top periphery of said internal workspace forming the top of said skeleton.

* * * * *